US007309191B2

(12) United States Patent
Kadiu

(10) Patent No.: US 7,309,191 B2
(45) Date of Patent: Dec. 18, 2007

(54) SHORING SYSTEM

(76) Inventor: Max Kadiu, 19694 Auburn Dr., Cupertino, CA (US) 95014

( * ) Notice: Subject to any disclaimer, the term of this patent is extended or adjusted under 35 U.S.C. 154(b) by 0 days.

(21) Appl. No.: 10/792,354

(22) Filed: Mar. 2, 2004

(65) Prior Publication Data

US 2004/0170478 A1 Sep. 2, 2004

Related U.S. Application Data

(63) Continuation-in-part of application No. 10/414,710, filed on Apr. 15, 2003, now Pat. No. 7,048,471, and a continuation-in-part of application No. 09/543,442, filed on Apr. 5, 2000, now Pat. No. 6,821,057.

(51) Int. Cl.
*E02D 5/00* (2006.01)

(52) U.S. Cl. ..... 405/282

(58) Field of Classification Search ..... 405/272, 405/282, 284

See application file for complete search history.

(56) References Cited

U.S. PATENT DOCUMENTS

| | | | |
|---|---|---|---|
| 1,794,704 | A | 3/1931 | Miller |
| 1,847,842 | A | 3/1932 | Cauley, Jr. et al. |
| 1,877,351 | A | 9/1932 | Meem |
| 1,895,985 | A | 1/1933 | Goldsborough |
| 1,909,980 | A | 5/1933 | Newman |
| 2,188,077 | A | 1/1940 | Dowd |
| 2,350,113 | A | 5/1944 | Hurley |
| 2,482,367 | A | 9/1949 | Ravers, Jr. |
| 2,584,015 | A | 1/1952 | Hawes |
| 2,659,210 | A | 11/1953 | Stengel et al. |
| 2,796,738 | A | 6/1957 | Moore |
| 2,908,140 | A | 10/1959 | Everson, Jr. |
| 2,956,409 | A | 10/1960 | Wicke |
| 2,994,974 | A | 8/1961 | Domenighetti |
| 3,159,977 | A | 12/1964 | De Lillo |
| 3,159,978 | A | 12/1964 | De Lillo |
| 3,186,177 | A | 6/1965 | Kannenberg |
| 3,212,270 | A | 10/1965 | Benintend |

(Continued)

*Primary Examiner*—Gary S. Hartmann

(57) ABSTRACT

This shoring system enters in the category of slide rail shoring systems, including rails, panels and strutting assemblies. It applies on shoring of excavations of various shapes such as trenches, rectangular and polygonal pits of great or lesser depth. Rails are of two types, linear or corner rails. Pairs of linear rails are spaced apart along excavation so that a strutting assembly keeps opposite rails of a pair of rails pressing against wall of excavation; corner rails are placed on the corners of any polygonal shaped excavation. Shoring panels slide vertically between adjacent rails creating a shoring wall on two or more sides of excavation. Rails have opposite sides provided with an outer and an inner guide for sliding vertically panels. The outer guide runs the full length of rail while inner guide is halfway from the bottom up reducing the weight of rail and easing installation and removal of panels. The corner rails are adopted to shore pits of polygonal shape of four or more corners eliminating the need of cumbersome strutting assemblies inside excavation. Linear rails have frontally an external edge guide so that at least one strutting assembly slides interlocked between two oppositely held linear rails. The strutting assembly has a horizontal spreader and two vertical members and is modulable by mean that two or more of them could be assembled together using vertical extension members. Strutting assembly is provided with rollers to ease its vertical mobility. Shoring panels are of equal design and access the rail laterally by swinging within outer and inner guides.

14 Claims, 12 Drawing Sheets

U.S. PATENT DOCUMENTS

| | | | |
|---|---|---|---|
| 3,224,201 | A | 12/1965 | Brunton |
| 3,230,720 | A | 1/1966 | Bennett |
| 3,263,430 | A | 8/1966 | Bryan |
| 3,295,330 | A | 1/1967 | Meshorer |
| 3,331,210 | A | 7/1967 | Wenninger |
| 3,335,573 | A | 8/1967 | Ward |
| 3,347,049 | A | 10/1967 | Faltersack et al. |
| 3,362,167 | A | 1/1968 | Ward |
| 3,379,018 | A | 4/1968 | Frentzel et al. |
| 3,393,521 | A | 7/1968 | Cammisa |
| 3,404,533 | A | 10/1968 | Brunton |
| 3,470,699 | A | 10/1969 | Cox |
| 3,530,679 | A | 9/1970 | Krings |
| 3,584,465 | A | 6/1971 | Holl |
| 3,593,528 | A | 7/1971 | Pavese |
| 3,621,660 | A | 11/1971 | Krings |
| 3,668,874 | A | 6/1972 | Krings |
| 3,710,578 | A | 1/1973 | Inoue |
| 3,727,413 | A | 4/1973 | Christen |
| 3,729,938 | A | 5/1973 | Morrice |
| 3,766,740 | A | 10/1973 | Teegen |
| 3,782,125 | A | 1/1974 | Holl |
| 3,782,126 | A | 1/1974 | Pavese |
| 3,788,086 | A | 1/1974 | West, Jr. |
| 3,791,151 | A | 2/1974 | Plank |
| 3,831,384 | A | 8/1974 | Kempster |
| 3,851,856 | A | 12/1974 | Berg |
| 3,858,399 | A | 1/1975 | Krings |
| 3,864,921 | A | 2/1975 | Marx et al. |
| 3,869,867 | A | 3/1975 | Krings |
| 3,881,679 | A | 5/1975 | Krings |
| 3,910,053 | A | 10/1975 | Krings |
| 3,910,054 | A | 10/1975 | Krings |
| 3,937,026 | A | 2/1976 | Krings |
| 3,950,952 | A | 4/1976 | Krings |
| 3,967,454 | A | 7/1976 | Barnes |
| 3,969,852 | A | 7/1976 | Krings |
| 3,995,565 | A | 12/1976 | Kersey |
| 3,999,393 | A | 12/1976 | Krings |
| 4,019,328 | A | 4/1977 | Koehl |
| 4,048,778 | A | 9/1977 | Krings |
| 4,054,033 | A | 10/1977 | Pillosio |
| 4,056,940 | A | 11/1977 | Fisher |
| 4,059,964 | A | 11/1977 | Pavese |
| 4,090,365 | A | 5/1978 | Nieber |
| 4,099,386 | A | 7/1978 | Sagasta |
| 4,114,383 | A | 9/1978 | Nieber |
| 4,139,324 | A | 2/1979 | Krings |
| 4,145,891 | A | 3/1979 | Krings |
| 4,154,062 | A | 5/1979 | Koehl |
| 4,159,585 | A | 7/1979 | Brown |
| 4,168,053 | A | 9/1979 | Boenninghaus |
| 4,188,159 | A | 2/1980 | Clarke et al. |
| 4,199,278 | A | 4/1980 | Koehl |
| 4,202,649 | A | 5/1980 | Cook et al. |
| 4,247,997 | A | 2/1981 | Paurat et al. |
| 4,259,028 | A | 3/1981 | Cook |
| 4,259,029 | A | 3/1981 | Koehl |
| 4,259,030 | A | 3/1981 | Montoya |
| 4,274,763 | A | 6/1981 | Krings |
| 4,279,548 | A | 7/1981 | Ramey |
| 4,310,267 | A | 1/1982 | Davis |
| 4,345,857 | A | 8/1982 | Krings |
| 4,370,079 | A | 1/1983 | Pizzirani |
| 4,372,709 | A | 2/1983 | Krings |
| 4,376,599 | A | 3/1983 | Krings |
| 4,421,440 | A | 12/1983 | Scheepers |
| 4,453,861 | A | 6/1984 | Bretz et al. |
| 4,453,863 | A | 6/1984 | Sutton et al. |
| 4,472,090 | A | 9/1984 | Krings |
| 4,484,842 | A | 11/1984 | Engelhaupt |
| 4,487,530 | A | 12/1984 | Morrice |
| 4,501,517 | A | 2/1985 | Seyle |
| 4,521,137 | A | 6/1985 | Brecht |
| 4,547,097 | A | 10/1985 | Bell |
| 4,548,528 | A | 10/1985 | Bell |
| 4,591,298 | A | 5/1986 | Fukumori et al. |
| 4,657,442 | A | 4/1987 | Krings |
| 4,659,261 | A | 4/1987 | Chiaves |
| 4,682,914 | A | 7/1987 | Aihara et al. |
| 4,685,837 | A | 8/1987 | Cicanese |
| 4,695,204 | A | 9/1987 | Bell |
| 4,696,607 | A | 9/1987 | Ressi di Cervia |
| 4,752,157 | A | 6/1988 | Ischebeck et al. |
| 4,787,781 | A | 11/1988 | Bradberry |
| 4,843,780 | A | 7/1989 | Krings |
| 4,874,271 | A | 10/1989 | Arnold |
| 4,886,399 | A | 12/1989 | Pidgeon |
| 4,900,197 | A | 2/1990 | Ward |
| 4,960,258 | A | 10/1990 | Stocker et al. |
| 4,993,877 | A | 2/1991 | Beamer |
| 4,993,878 | A | 2/1991 | Beamer |
| 4,993,880 | A | 2/1991 | Collins |
| 5,000,621 | A | 3/1991 | Beamer |
| 5,011,331 | A | 4/1991 | Clavarino |
| 5,044,831 | A | 9/1991 | Myles et al. |
| 5,052,862 | A | 10/1991 | Uffmann |
| 5,073,066 | A | 12/1991 | Richland |
| 5,080,533 | A | 1/1992 | Cooper |
| 5,096,334 | A | 3/1992 | Plank |
| 5,123,785 | A | 6/1992 | Orfei |
| 5,129,763 | A | 7/1992 | Deusenbery |
| 5,154,541 | A | 10/1992 | Boren et al. |
| 5,158,398 | A | 10/1992 | Pinho |
| 5,167,468 | A | 12/1992 | Crafton |
| 5,174,685 | A | 12/1992 | Buchanan |
| 5,180,256 | A | 1/1993 | Krings |
| 5,183,316 | A | 2/1993 | Ottestad |
| 5,188,332 | A | 2/1993 | Callas |
| 5,190,412 | A | 3/1993 | Salvatore |
| 5,195,849 | A | 3/1993 | Stapleton |
| 5,197,829 | A | 3/1993 | Krings |
| 5,199,824 | A | 4/1993 | Smith et al. |
| 5,209,606 | A | 5/1993 | Plank |
| 5,232,312 | A | 8/1993 | Jennings et al. |
| 5,232,313 | A | 8/1993 | Jennings et al. |
| 5,259,705 | A | 11/1993 | Breaux et al. |
| 5,277,522 | A | 1/1994 | Pertz |
| 5,281,051 | A | 1/1994 | Stegall |
| 5,290,129 | A | 3/1994 | Rody et al. |
| 5,302,054 | A | 4/1994 | Winkler et al. |
| 5,305,568 | A | 4/1994 | Beckerman |
| 5,306,103 | A | 4/1994 | Spencer |
| 5,310,289 | A | 5/1994 | Hess |
| 5,310,290 | A | 5/1994 | Spencer |
| 5,320,440 | A | 6/1994 | Papadopoulos |
| 5,336,023 | A | 8/1994 | Burdine |
| 5,344,258 | A | 9/1994 | Papadopoulos |
| 5,348,421 | A | 9/1994 | Stegall |
| 5,393,171 | A | 2/1995 | Stegall |
| 5,399,057 | A | 3/1995 | Cunic |
| 5,401,122 | A | 3/1995 | Pate, Jr. |
| 5,499,890 | A | 3/1996 | Kishi |
| 5,503,504 | A | 4/1996 | Hess et al. |
| 5,513,555 | A | 5/1996 | Plank et al. |
| 5,516,238 | A | 5/1996 | Beury |
| 5,522,678 | A | 6/1996 | Marshall et al. |
| 5,527,137 | A | 6/1996 | Spencer |
| 5,533,838 | A | 7/1996 | Kundel |
| 5,595,459 | A | 1/1997 | LoMonaco |
| 5,611,643 | A | 3/1997 | Tallard |
| 5,624,206 | A | 4/1997 | Cohen et al. |
| 5,669,738 | A | 9/1997 | Kundel |
| 5,720,580 | A | 2/1998 | Ryhsen |

5,725,330 A 3/1998 Krings
5,735,642 A 4/1998 Barringer
5,741,091 A 4/1998 St. George et al.
5,829,921 A 11/1998 Krings
5,839,707 A 11/1998 Barringer
5,865,567 A 2/1999 Wilkinson
5,868,060 A 2/1999 Plank et al.
5,868,526 A 2/1999 Caulder
5,876,153 A 3/1999 Krings
5,885,033 A 3/1999 Krings
5,902,075 A 5/1999 Krings
5,931,607 A 8/1999 Hess
5,931,608 A 8/1999 Wilkinson
6,017,170 A 1/2000 Michalo
6,039,522 A 3/2000 Cardona
6,155,750 A 12/2000 Wu et al.
6,164,874 A 12/2000 May
6,164,875 A 12/2000 Wu et al.
6,224,296 B1 5/2001 Fukumori
6,267,538 B1 7/2001 Caldwell
6,416,259 B1 7/2002 Meyer
6,443,665 B1 9/2002 Kundel, Sr.
6,474,911 B1 11/2002 Krings

SHORING SYSTEM

CROSS-REFERENCE TO RELATED APPLICATIONS

This is a continuation in part of application of U.S. patent application Ser. No. 10/414,710 filed Apr. 15, 2003 now U.S. Pat. No. 7,048,471 and U.S. patent application Ser. No. 09/543,442, filed Apr. 5, 2000, now U.S. Pat. No. 6,821,057.

TECHNICAL FIELD

This invention discloses a shoring system for use in trenches, pits and other open excavations.

BACKGROUND OF THE INVENTION

Shoring systems are used to prevent walls of open excavations to cave in and secure the safety of working place. This invention relates to a particular type of shoring devices called 'Slide Rail Shoring System' consisting of rails, large shoring panels and horizontal struts or strutting assemblies. Each rail has laterally, on either side, one or more guides for sliding shoring panels. According to alignment of lateral guides on either side of the rail two distinct types of rails are specified, linear rail and corner rail. Panels sliding on either side of a linear rail follow same alignment forming conjointly a straight shoring wall. Panels sliding within one side of a corner rail are perpendicular to panels sliding within other side, outlining a 90 degrees turn of shoring wall. The linear rail has a frontal guide relative to interior of excavation, for sliding at least one horizontal strut or a strutting assembly. Linear rails are used in pairs, which are spaced apart along the excavation. Linear rails of a pair of rails are held vertically parallel and pressed against either wall of excavation by at least one horizontal strut or strutting assembly. Shoring panels slide within respective guides of adjacent linear rails of pair of rails creating thereby a stepped shoring wall. The outermost and innermost steps of the shoring wall relative to interior of excavation are called respectively outer wall and inner wall, so the lateral guides on either side of the rail. Corner rails are used on each corner of a rectangular shaped open excavation.

Previous slide rail shoring systems as disclosed in U.S. Pat. Nos. 3,910,053 and 4,657,442 (Krings), use rails having laterally individual formlocking channel guides of C-shaped section that interlock the guide edge of T-shaped section provided alongside each lateral end of shoring panels. This type of interlocking highly concentrates the stresses in the contact between rail and panel engendering damages in both rail and panels, strongly limiting the successful use of this shoring device.

The U.S. Pat. Nos. 5,310,289 and 5,503,504 (Hess et al.), disclose a rail having laterally on either side only one channel guide for both inner and outer walls, created respectively by an inner panel and an outer panel named according to the shoring wall they create. The channel guide has a U-shape and has on backside of the guide channel a square bar to interlock the outer panel within the rail. The guide edge of inner panel is not interlocked within rail and slides freely within presenting thereby a risk to kick in the trench when adjacent rails are not aplomb, what becomes a serious safety issue when depth of excavation is over 20 ft. deep. The outer and inner panels have unequal design and are not interchangeable raising inventory concerns in term of panel inventory, their handling and administration as well as various inconveniences during installation and removal of shoring system in job site.

U.S. Pat. Nos. 6,164,874 (May) discloses a slide rail shoring system as improvement or ulterior development of those published in U.S. Pat. Nos. 5,310,289 (Hess) and European Pat. Nos. 0 100 083 (May). Likewise, this shoring system uses two unequal types of shoring panels, an outer panel, which slides formlockingly within rail, and an inner panel, which slides freely within rail. This slide rail shoring system manifests same functionality and drawbacks as per those discussed previously above.

BRIEF SUMMARY OF THE INVENTION

This invention relates to a slide rail shoring system including rails, large shoring panels and strutting assemblies as described above. Each rail has lengthwise, laterally on either side, one or more U-shaped guides, each of them provided lengthwise with a locking bar to interlock shoring panels sliding within. The outer guide runs all along the rail, while the inner guide runs quasi halfway from the bottom of rail simplifying the insertion of shoring panels within inner guide and reducing the weight of rail as well. Each linear rail has lengthwise, frontally outward towards interior of excavation, one edge guide to engage cooperatively into a C-shaped guide provided on either side of each strutting assembly. Usually, the corner rails are not provided with a frontal guide because there is little or no need for them to be supported by strutting assembly against walls of excavation. However, one variation of corner rail having a frontal guide is shown herewith as well.

In one variation, the lateral guides on opposite sides of corner rail are oriented perpendicularly to each other for creating perpendicular shoring walls. This variation of corner rail is used for shoring pits of rectangular shape.

In another variation, the lateral guides on either side of the corner rail form an angle of 120 degrees with each other, so the panels and shoring walls on either side of the corner rail. This variation of corner rail is used for shoring pits of hexagonal shape. Yet other variations of corner rails for shoring polygonal shaped pits of five or more corners are revealed. These variations find enormous interest when it comes to shoring of big sized pits because it eliminates the need of long and cumbersome strutting assemblies between opposite linear rails.

The shoring panels have identical design. Each panel has laterally, on either end, one edge guide to be received cooperatively within any of lateral guides of the rail. Each edge guide of panel has lengthwise on backside relative to interior of excavation, a locking bar to interlock within guide of rail.

The strutting assembly has one horizontal spreader fastened and two vertical members. Each vertical member is provided with a C-shaped guide that encompasses the frontal edge guide of linear rail to slide formlockingly over it. Further, each vertical member has on upper and lower ends one or more rollers to ease the displacement of strutting assembly along linear rail. In a modified variation, the upper and lower ends of each vertical member are also provided with fastening flanges so that vertical extension members could be used to assemble together two strutting assemblies usually needed in shoring of deep excavations.

As described above, the intent of present invention is to provide a shoring system that uses same type of shoring panel for the outer and inner shoring walls, while reduces the friction and stresses in the contacts between components. Another subject of this invention is to increase the safety by interlocking shoring panels within both outer and inner guides of the rail, while providing specific features for the panels such as accessing the guides of the rail by just swinging within. Yet, a subject of this invention is to reduce the weight of rail by adopting two different combinations of structural shapes for upper part and the lower part of the rail resulting in an easier installation and removal of panels of inner shoring wall as well. An important aspect of present invention is the use of common structural shapes allowing to lighten the components, ease the manufacturing process and provide better strength.

Another subject of present invention is to present a modulable strutting assembly able to adapt various technical specifications or configurations and provide a big pipe culvert.

The new features considered as characteristic for the invention are set forth in the appended claims. Other advantages of invention are to be appreciated in view of the following description and drawings.

DETAILED DESCRIPTION OF THE INVENTION

Figure 1:
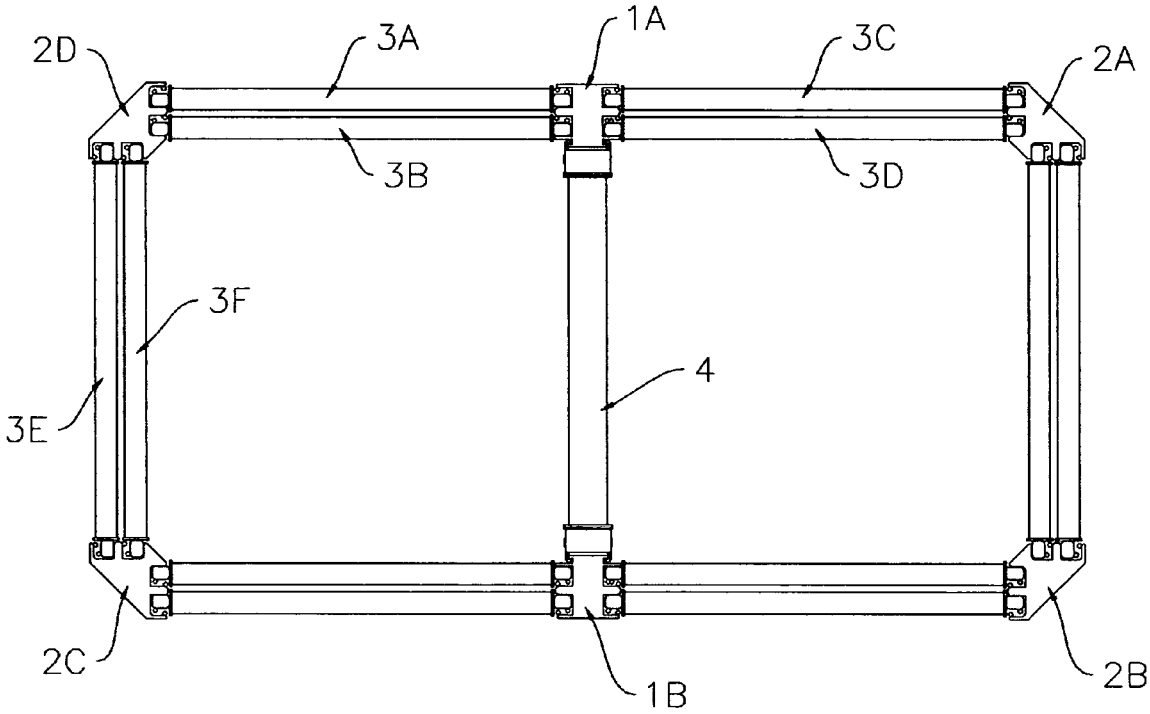
FIG. 1 is a top view of shoring system including rails, shoring panels and strutting assembly applied in a pit of rectangular shape.

Referring to the drawings where like numerals indicate like elements, various embodiments of present invention are illustrated.

Figure 2:
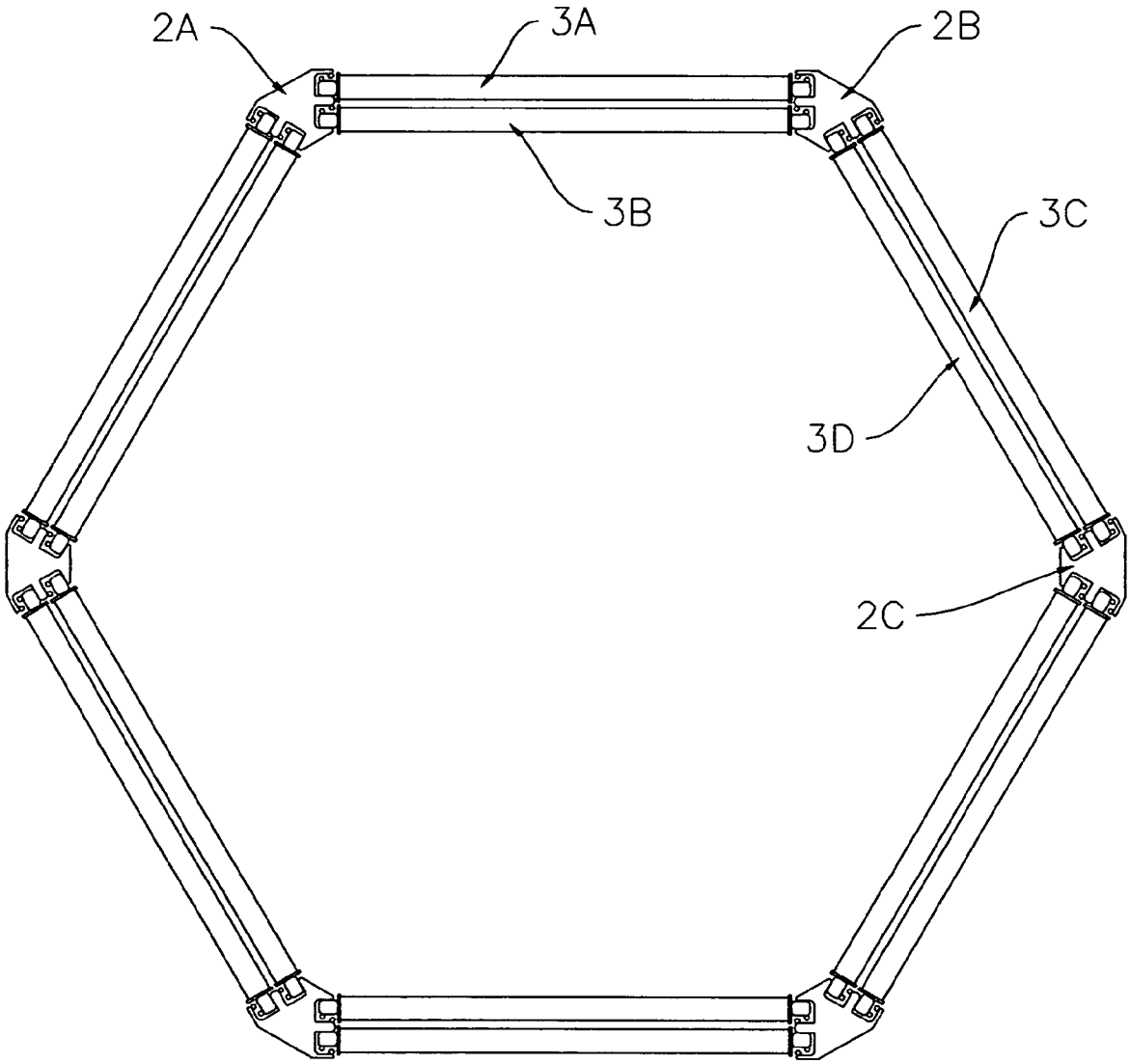
FIG. 2 is a top view of shoring system including rails and shoring panels applied in a pit of hexagonal shape.

FIG. 1 shows a top view of an assembled shoring system in a rectangular shaped pit including linear rails 1A, 1B, corner rails 2A, 2B, 2C, 21D, several shoring panels like 3A, 3B, 3C, 31D, 3E, 31F and a strutting assembly 4. Linear rails 1A and 1B are arranged on either side of the pit and held oppositely against each other by the strutting assembly 4. Corner rails 2A, 2B, 2C and 21D are arranged respectively on each corner of the pit. Shoring panels 3A, 3C, 3E form an outer shoring wall relative to interior of the pit while panels 3B, 31D, 3F form an inner shoring wall. Panels 3A and 3C form a straight shoring wall when sliding on opposite sides of liner rail 1A, while panels 3A and 3E outline a 90 degrees turn of shoring wall when sliding on opposite sides of corner rail 2B FIG. 2 shows a top view of an assembled shoring system in a pit of hexagonal shape illustrating several corner rails like 2A, 2B, 2C, outer shoring wall formed by panels like 3A, 3C and inner shoring wall formed by panels like 3B, 31D. Shoring walls outline 120 degrees turn on either side of each corner rail.

Figure 3:
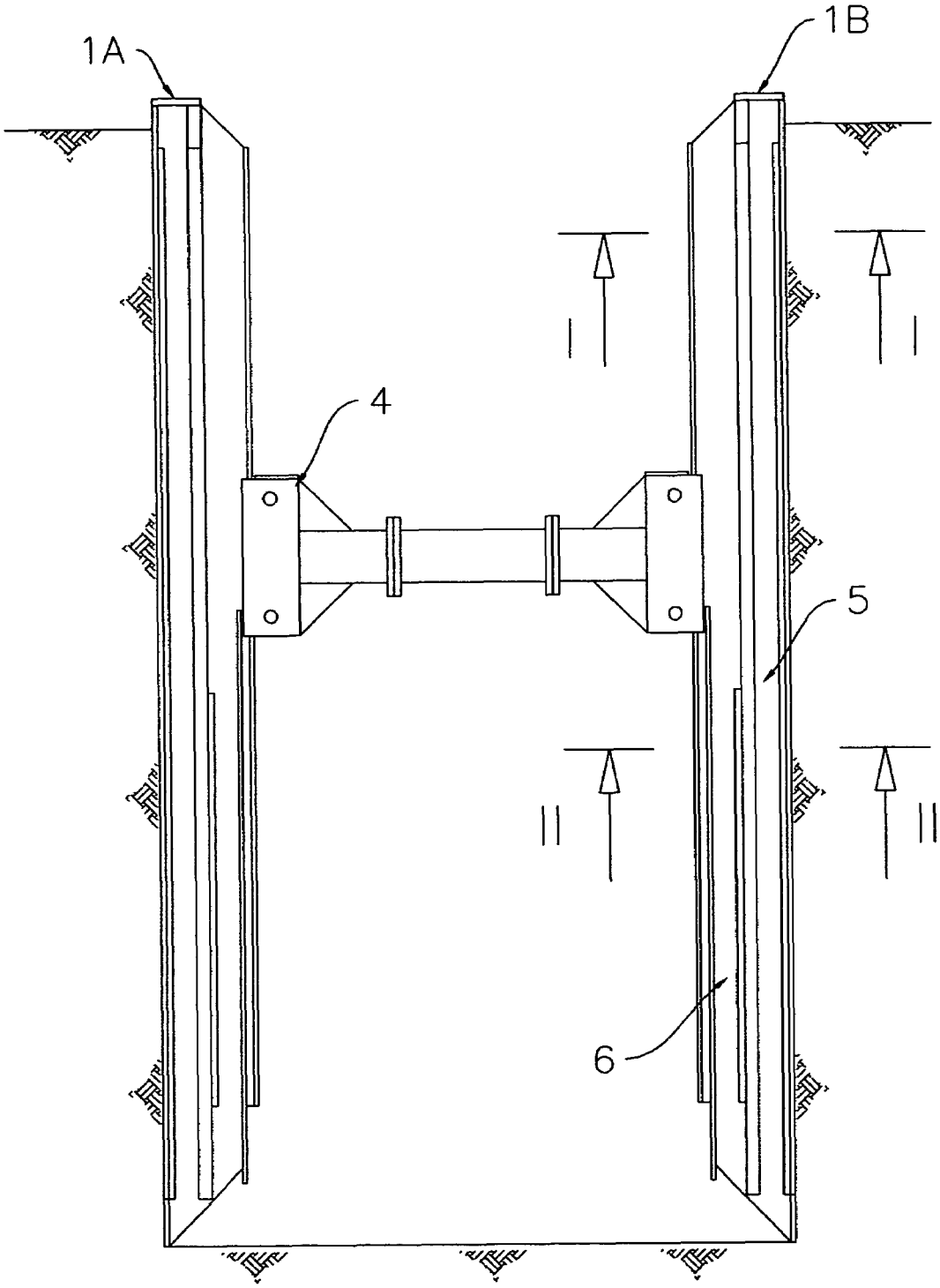
FIG. 3 is a sectional view of a trench showing two linear rails held apart by a strutting assembly.

FIG. 3 illustrates linear rails 1A and 1B located on either side of an excavation such as trench or pit, supported by the strutting assembly 4. Each linear rail has laterally, on either side, an outer guide 5 and an inner guide 6 relative to interior of trench, for sliding shoring panels to form respectively an outer shoring wall and an inner shoring wall. The outer guide 5 runs along entire length of linear rail while the inner guide 6 runs quasi halfway from the bottom up. Therefore, in term of structural components, the linear rail has lengthwise an lower section defined by the length of inner guide 6 and an upper section defined as complementary to lower section. The lower section usually represents, but not limited, 30 to 75% of total length of linear rail.

Figure 4:
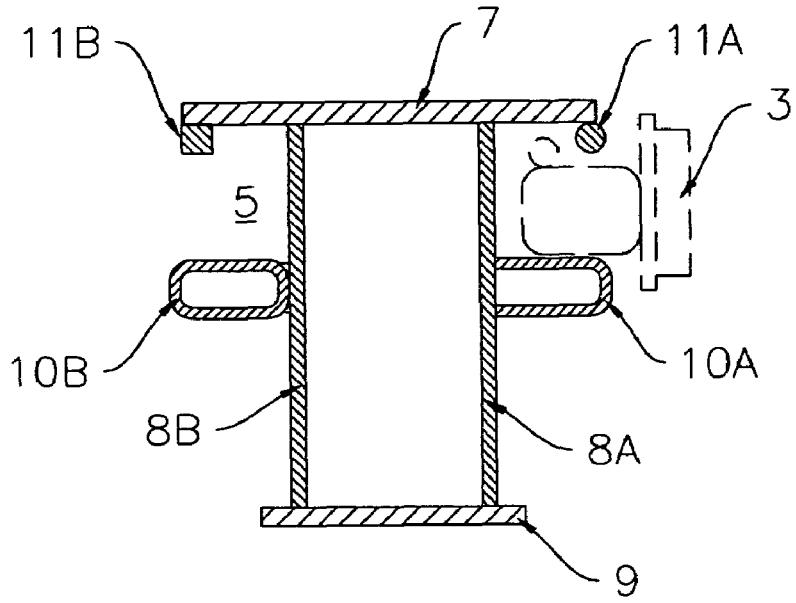
FIG. 4 is a sectional view taken along the line I-I of the FIG. 3, showing the cross section of the upper section of linear rail.
Figure 5:
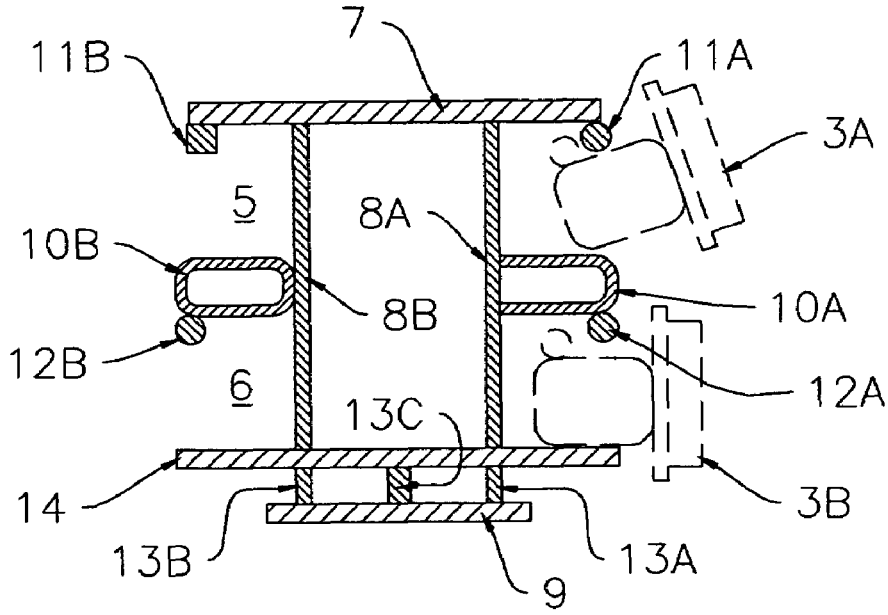
FIG. 5 is a sectional view taken along the line II-II of the FIG. 3, showing the cross section of the lower section of linear rail.

As shown in FIG. 4 and FIG. 5, the linear rail has a back flange 7 to press against the wall of excavation, a narrower front flange 9, two identical lateral flanges 8A, 8B held parallel to each other and spaced apart at distance comparable to but inferior than width of front flange 9 and an intermediary flange 14 parallel to back flange 7 and front flange 9. In the upper section of linear rail, FIG. 4, lateral flanges 8A and 8B are welded perpendicularly onto back flange 7 and front flange 9. In the lower section of linear rail, FIG. 5, lateral flanges 8A, 8B are narrower than at upper section and welded perpendicularly onto back flange 7 and intermediary flange 14. The front flange 9 remains parallel to back flange 7 and join intermediary flange 14 via two or more strips 13A, 13B, 13C. The outer side of each strip 13A and 13B are within alignment of outer side of each respective lateral flange 8A and 8B. Thus, the extent portions of front flange 9 on either side of lateral flanges 8A, 8B and strips 13A, 13B, shape an edge guide to be encompassed by the C-shaped guides provided in strutting assembly. The back flange 7 and intermediary flange 14 project symmetrically outward of lateral flanges 8A and 8B shaping a channel structure comprising opposite sides. Each opposing side includes a separating member 10A preferably of U-shape or of rectangular shape 10B welded lengthwise respectively onto lateral flanges 8A and 8B at distance quasi equal between back flange 7 and intermediary flange 14. The separating member 10A of U-shape may be a partial or half section of a rectangular structural tube cut longitudinally on either side or may be formed by other means such as bending a flat bar or by joining (e.g. welding) flat bars. The separating member 10A the back flange 7 and lateral flange 8A form the outer guide for sliding shoring panel 3; the separating member 10A, intermediary flange 14 and lateral flange 8A form the inner guide for sliding shoring panel 3B. Locking bars 11A, 11B, of round or rectangular section, are welded inward quasi flush symmetrically on either lip of the back flange 7, so that panel 3 interlocks within outer guide but can access it by swinging. Similarly, locking bars 12A, 12B are respectively welded onto front side of each separating member 10A, 10B, flush to small side, to interlock panels sliding within inner guide. Locking bars 12A and 12B are optional if the length of linear rail is inferior to 20 ft.

Figure 6:
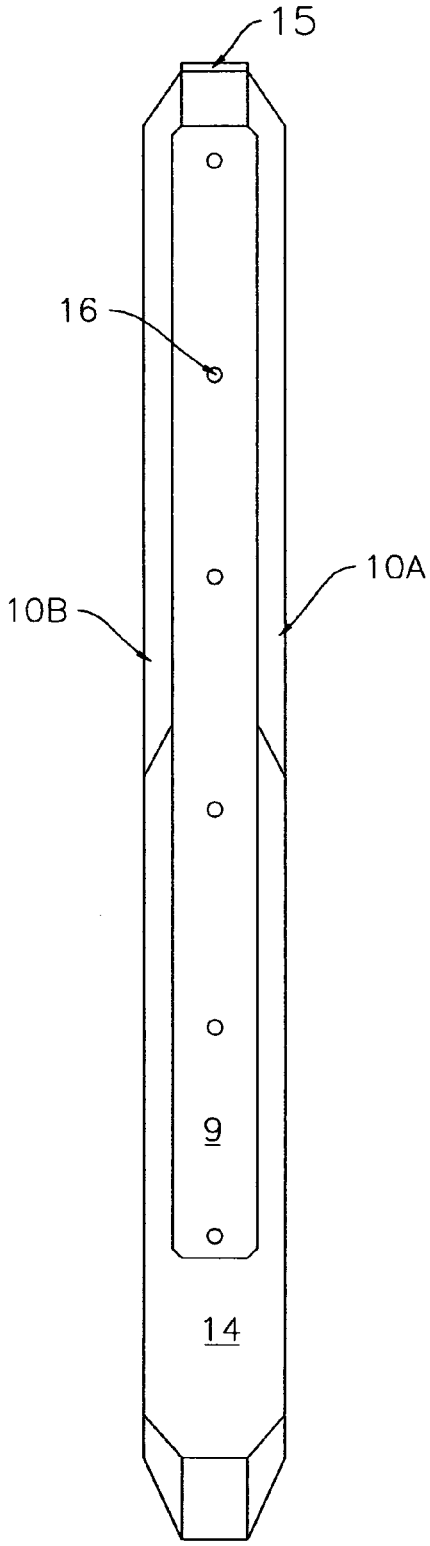
FIG. 6 is a front view of linear rail.
Figure 7:
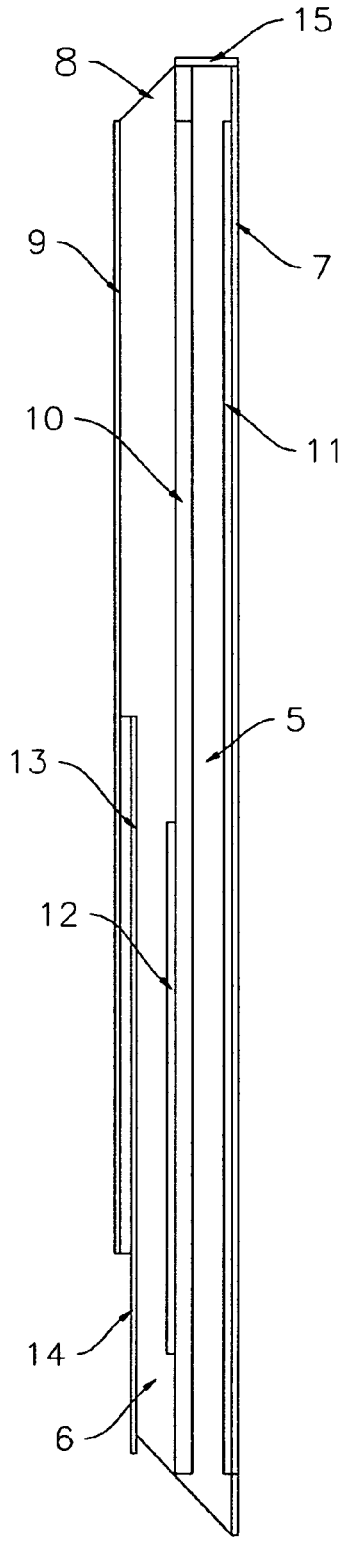
FIG. 7 is a side view of linear rail.

As shown in FIG. 6, the front flange 9 of linear rail is provided with several holes 16 for inserting stopping pins, not shown, to keep strutting assembly in various positions relative to linear rail. A pressing plate 15 is fastened on top of linear rail to prevent damages when pushing it down during installation in the ground. FIG. 7 shows that intermediary flange 14 runs halfway or slightly more from the bottom up of linear rail easing the insertion of panels within inner guide 6. Likewise, for same purposes, locking bars 11 and 12 could be partial relative to entire length of respectively outer guide 5 and inner guide 6. The front flange 9 could be slightly shorter than entire length of linear rail and so the strip 13 comparing to intermediary flange 14.

Figure 8:
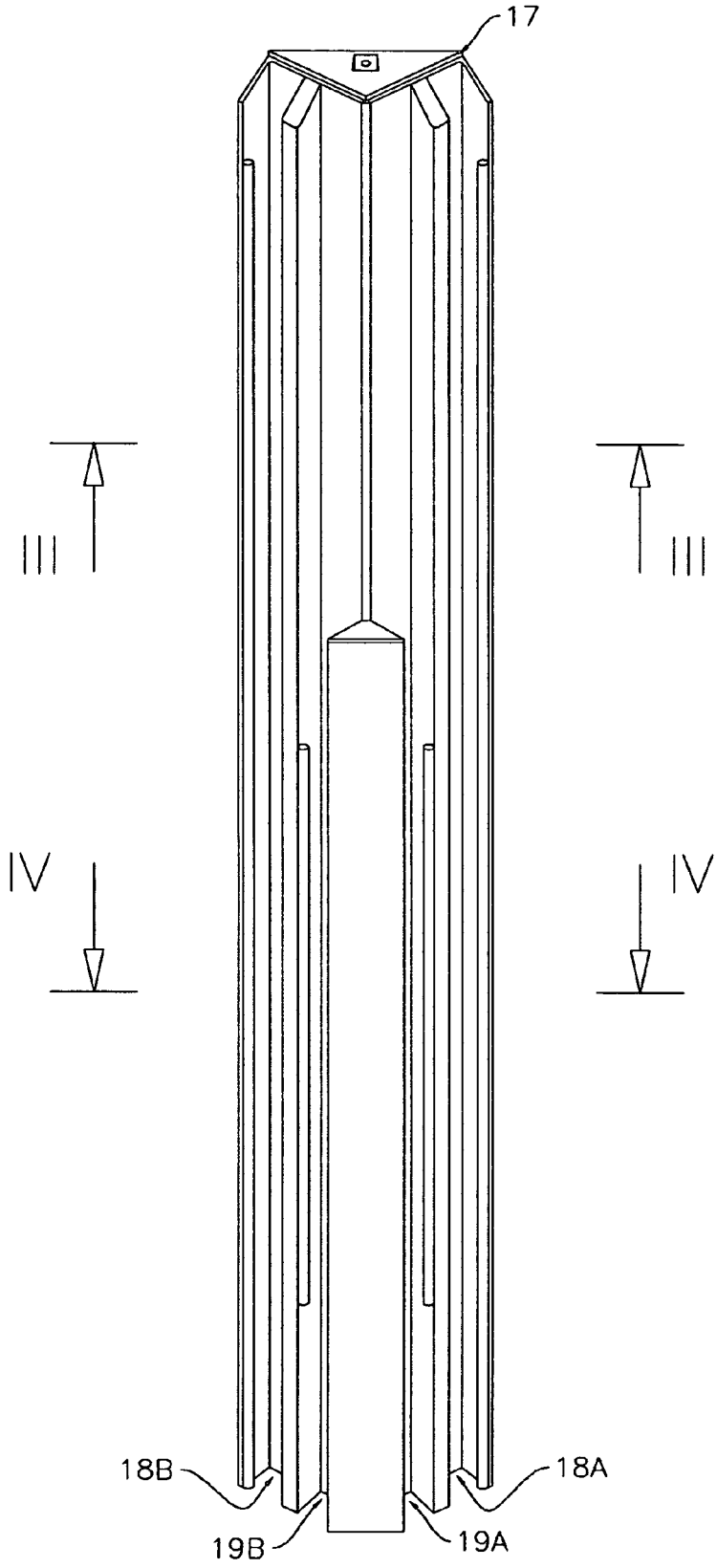
FIG. 8 is a three-dimensional view of a corner rail.
Figure 9:
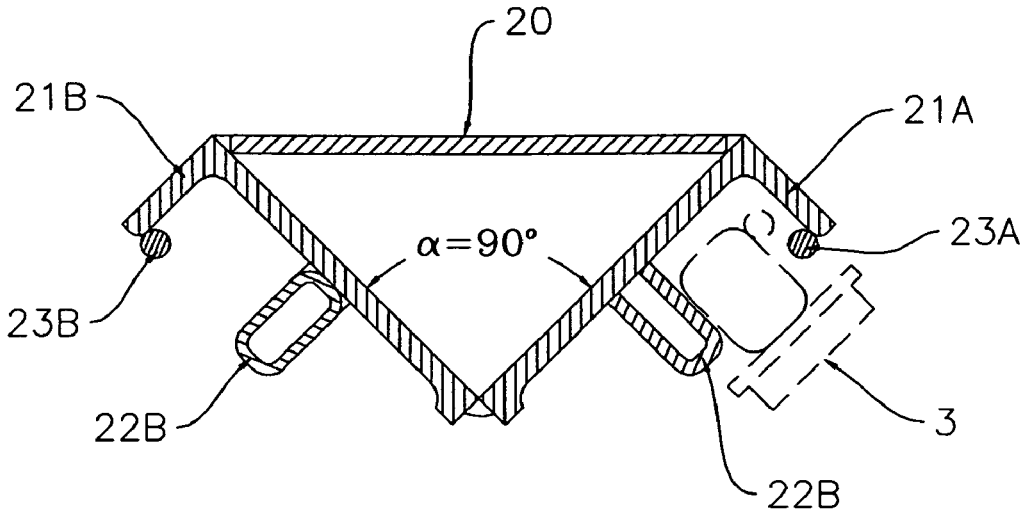
FIG. 9 is a sectional view taken along the plan III-III of FIG. 8, showing the cross section of the upper section of a corner rail.
Figure 10:
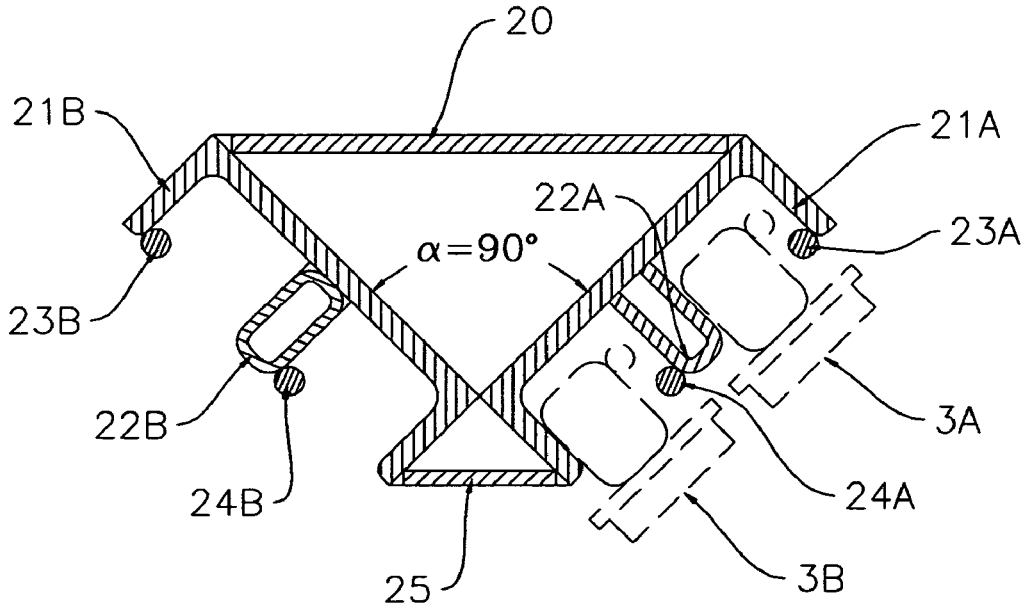
FIG. 10 is a sectional view taken along the plan IV-IV of FIG. 8, showing the cross section of the lower section of a corner rail.

FIG. 8 shows a three-dimensional view of a corner rail as viewed frontally from interior of excavation and slightly above it, depicting two opposing sides comprising respectively the outer guides 18A, 18B running along entire length of rail and inner guides 19A, 19B running partially from the bottom up. A pressing plate 17 is fastened on the top to prevent damages when pushing the corner rail down into the ground. As shown in FIG. 9 and FIG. 10, the upper and lower sections of corner rail have essentially the same components, consisting basically of a back flange 20 to press against the wall of excavation and two structural channels 21A, 21B. Said structural channels 21A, 21B could be standard channels, miscellaneous channels, specially formed channels or any other type fabricated by meaning of combining flat bars or cutting lengthwise section from rectangular tubes. The structural channels 21A and 21B are oppositely held with their respective flanges looking outward. The respective webs of structural channels 21A, 22B and back flange 20 are joined together to shape an isosceles triangle whose vertex angle α, is, but not limited, 90 degrees. Additional reinforcing/redundant plate stiffeners of triangular shape, not shown, may be applied to further secure the components together. Each opposite side includes a separating member 22A preferably of U-shape or of rectangular shape 22B welded at distance quasi equal from respective flanges of each structural channel 21A, 21B forming thereby the outer guide and the inner guide for sliding respectively the shoring panels 3A and 3B. For the upper section of corner rail, the flange of each structural channels 21A, 21B farthest from the back flange 20 is cut almost flush to the web easing the insertion of panels within inner guide. For the lower section of corner rail, a reinforcing/redundant flange 25 may be welded between flanges of structural channels 21A, 21B farthest from back flange 20. Locking bars 23A and 23B of round or rectangular section are fastened inward quasi flush onto each back flange of structural channels 21A, 21B. Thus, panels slide interlocked within outer guide but can access it by swinging. Similarly, a locking bar 24A, 24B is optionally welded onto each separating member 22A, 22B flush to narrow side and interior to inner guide, to interlock shoring panels sliding within.

Figure 11:
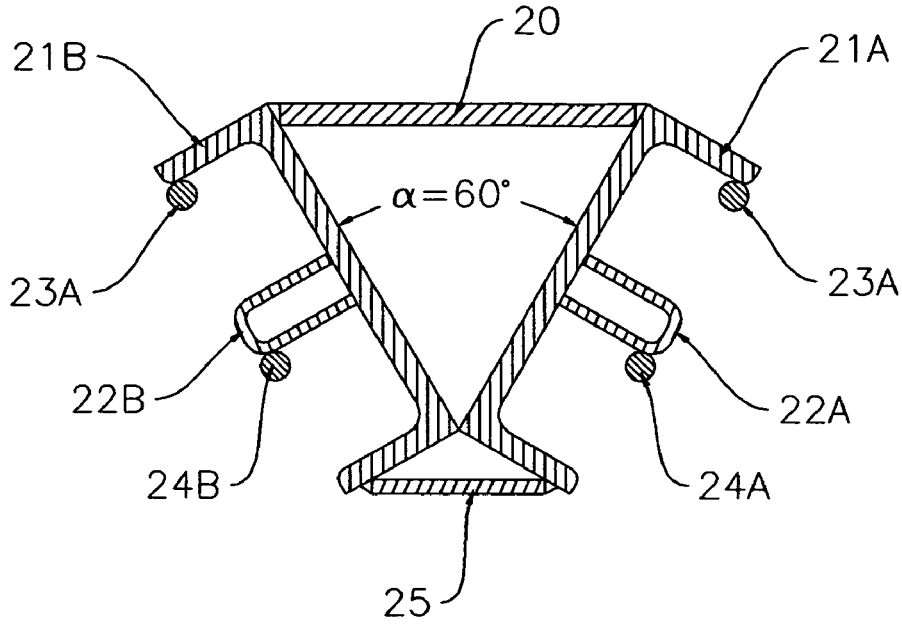
FIG. 11 is a schematic, top, fragmentary, sectional view of a variation of corner rail for shoring pits of hexagonal shape.

As shown in FIG. 11 the same structural components of corner rail as those presented above, could be used for making variations of corner rails for use in polygonal shaped pits. By just modifying the value of vertex angle α from 90 degrees to 60, 45, 30 or other, corner rails for shoring pits of respectively pentagonal, hexagonal, octagonal shape or other could be obtained.

Figure 12:
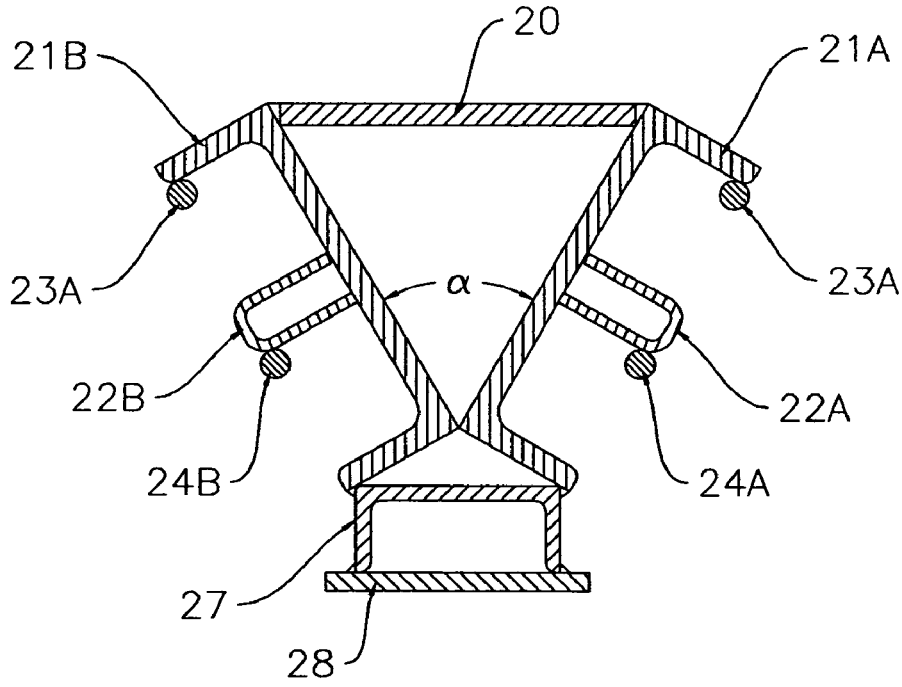
FIG. 12 is a schematic, top, fragmentary, sectional view a corner rail having a frontal edge guide for sliding strutting assembly.

In another variation as shown in FIG. 12, the corner rail is provided with an edge guide formed by a structural channel 27 and a guide flange 28 so that a strutting assembly could slide between oppositely held corner rails.

Figure 13:
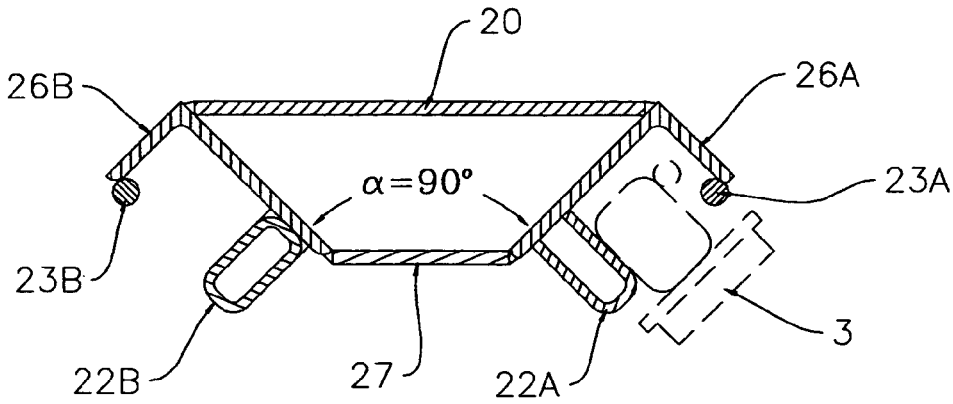
FIG. 13 is a schematic, top, fragmentary, sectional view of a variation of upper section of corner rails.

A complex variation of a corner rail having the lower section same as shown in FIG. 10 but the upper section modified is shown in FIG. 13. The upper section includes a back flange 20 and a narrower flange 27 distantly joined by intermediary of two structural angles 26A and 26B held oppositely outward inside out, to form an isosceles trapezoid. The angle a between oblique sides of trapezoid is, but not limited, 90 degrees or equal to vertex angle a of lower section of corner rail. The cross section of structural angles 26A, 26B fits within cross section of respective structural channels 21A, 21B of lower section so that both sections are joined together to form the entire corner rail. Each structural angle 26A has the separating member 22A to form the outer guide for sliding the panel 3, and the locking bars 23A weld inward onto the lip of free leg of structural angle 26A to interlock panels sliding within outer guide.

Other trivial variations of corner rails may be obtained. An example (not illustrated but with reference FIG. 9 and FIG. 10), could be the introduction of a redundant flange up front the back flange 20, between webs of structural channels 21A, 22B spacing them apart and forming an isosceles trapezoid preserving all other components, features and functions of corner rail, as discussed above.

Figure 14:
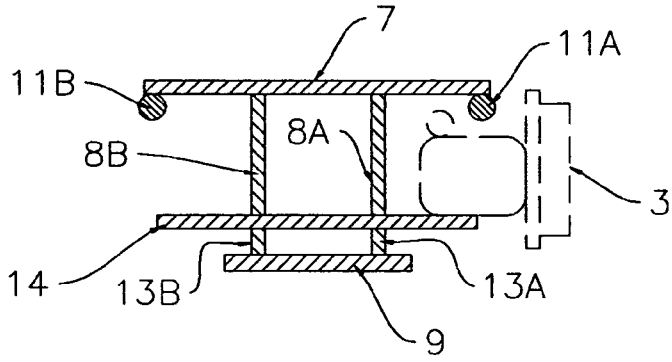
FIG. 14 is a schematic, top, fragmentary, sectional view of a linear rail having laterally, on opposite sides, only one guide for sliding shoring panels.
Figure 15:
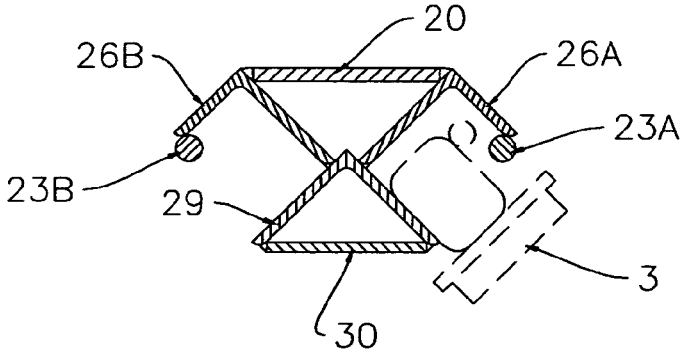
FIG. 15 is a schematic, top, fragmentary, sectional view of a corner rail having laterally, on opposite sides, only one guide for sliding shoring panels.

Variations of linear and corner rails for shoring shallow excavations are shown in FIG. 14 and FIG. 15. On both cases, the rails have opposite sides, each opposite side including only one guide for sliding panels 3 and are subsequently named mono-guide rails. As shown in FIG. 14, the mono-guide linear rail uses basically most of the components of linear rail discussed previously; the particularity resides on the fact that lateral guides on either side are shaped by the back flange 7, intermediary flange 14 and lateral flanges 8A and 8B. As shown in FIG. 15 the mono-guide corner rail uses an angle 29 to join lateral structural angles 26A and 26B and a reinforcing flange 30 on front side of it.

Figure 16:
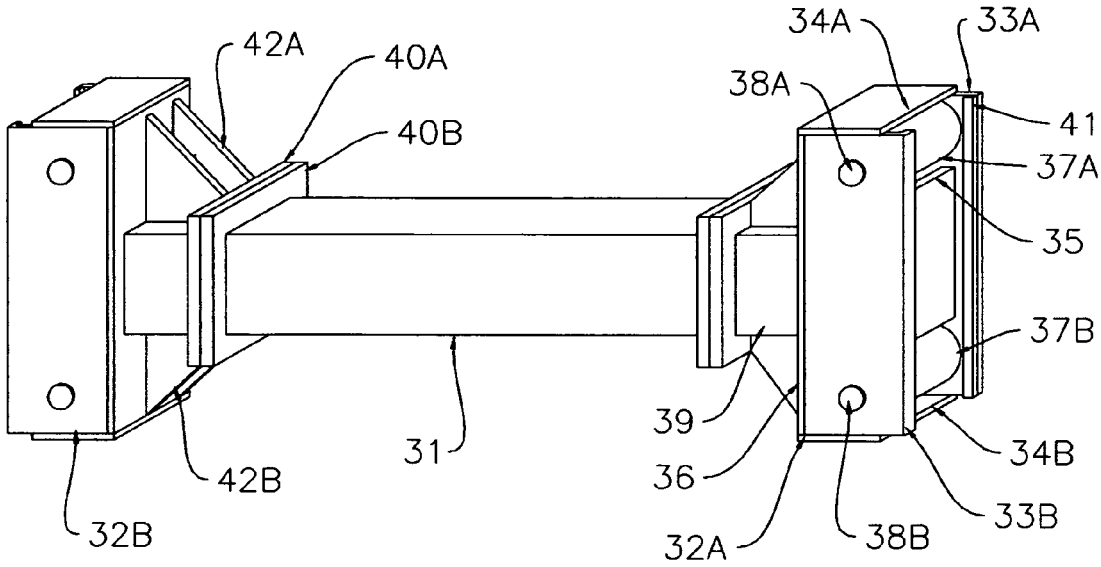
FIG. 16 is a three-dimensional view of the strutting assembly.

As shown in FIG. 16, the strutting assembly consists of one horizontal spreader 31 and two vertical members 32A, 32B mounted on either side of the spreader 31 by bolts, not shown, via contact flanges 40A, 40B. Each vertical member 32A, 32B, consists of two lateral plates 33A, 33B held parallel by an upper plate 34A and lower plate 34B, a supporting plate 36 and an inner plate 35. The lateral plates 33A and 33B project outward past the upper and lower plates 33A, 33B and inner plate 35. In one variation, each free lip of lateral plates 33A, 331B are bent perpendicularly towards each other to shape a guide of C-shaped section with inner plate 35. In another variation, each plate 33A, 33B, not bent, has a strip 41 of round or rectangular section weld inward flush onto respective lip to shape the C-shaped guide. The C-shaped guide of each vertical member 32A, 32B encompasses the edge guide of the linear rail and slide interlocked over it. The lateral plates 33A, 33B are provided with holes, not shown, where axles 38A and 38B are fasten so that at least one upper roller 37A and one lower roller 37B could be mounted to ease mobility of strutting assembly along the linear rail. The outermost line of contact over circumference of rollers 37A, 37B is past the inner plate 35 and plates 34A, 34B.

Figure 17:
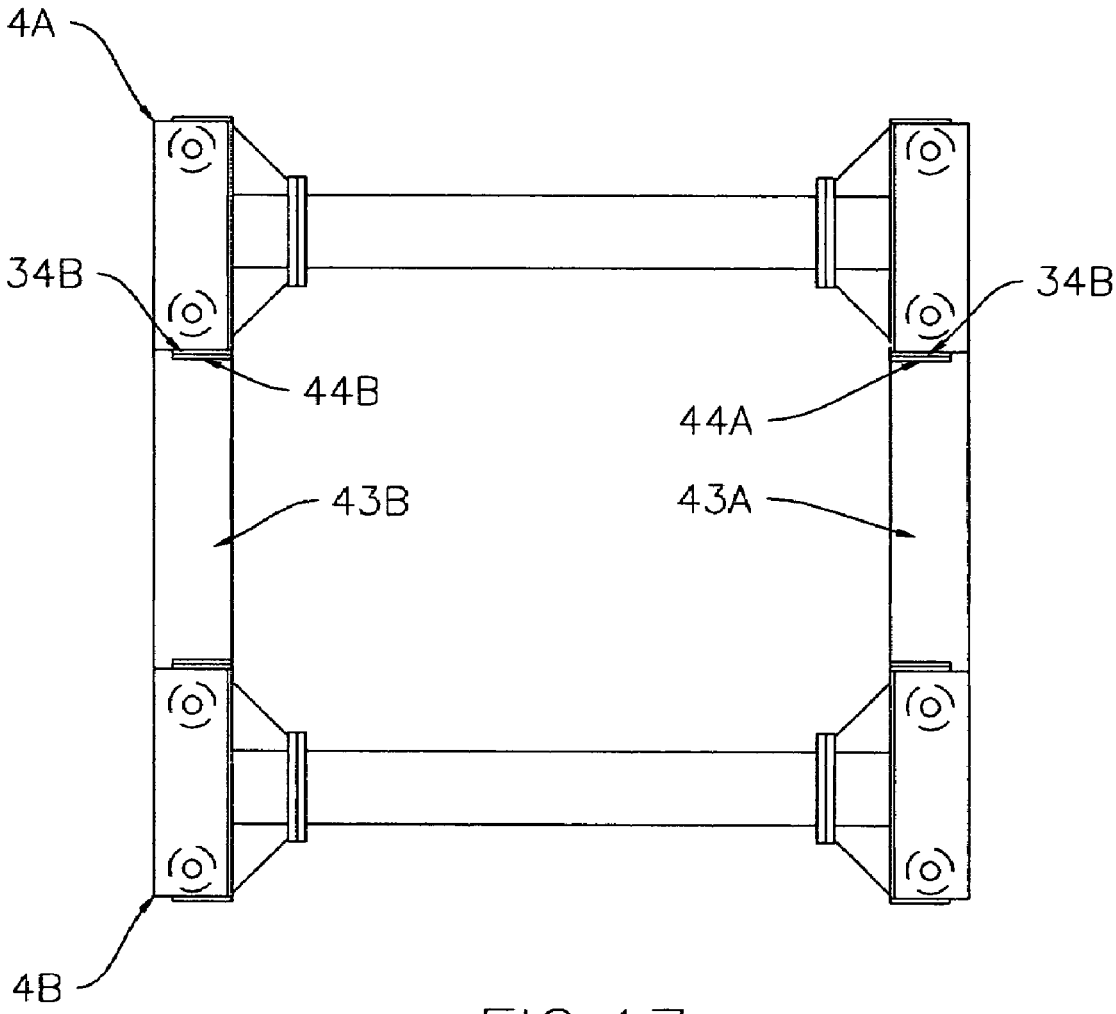
FIG. 17 is a lateral view of two strutting assemblies connected together by vertical extension members.

As shown in FIG. 17, two strutting assemblies are assembled together using vertical extension struts 43A, 43B provided with flanges 44A, 44B and connect onto lower plate 34A, 34B via bolts, not shown. Various lengths of vertical extension struts 43A, 43A may be selected to comply with required specifications of excavation.

Figure 18:
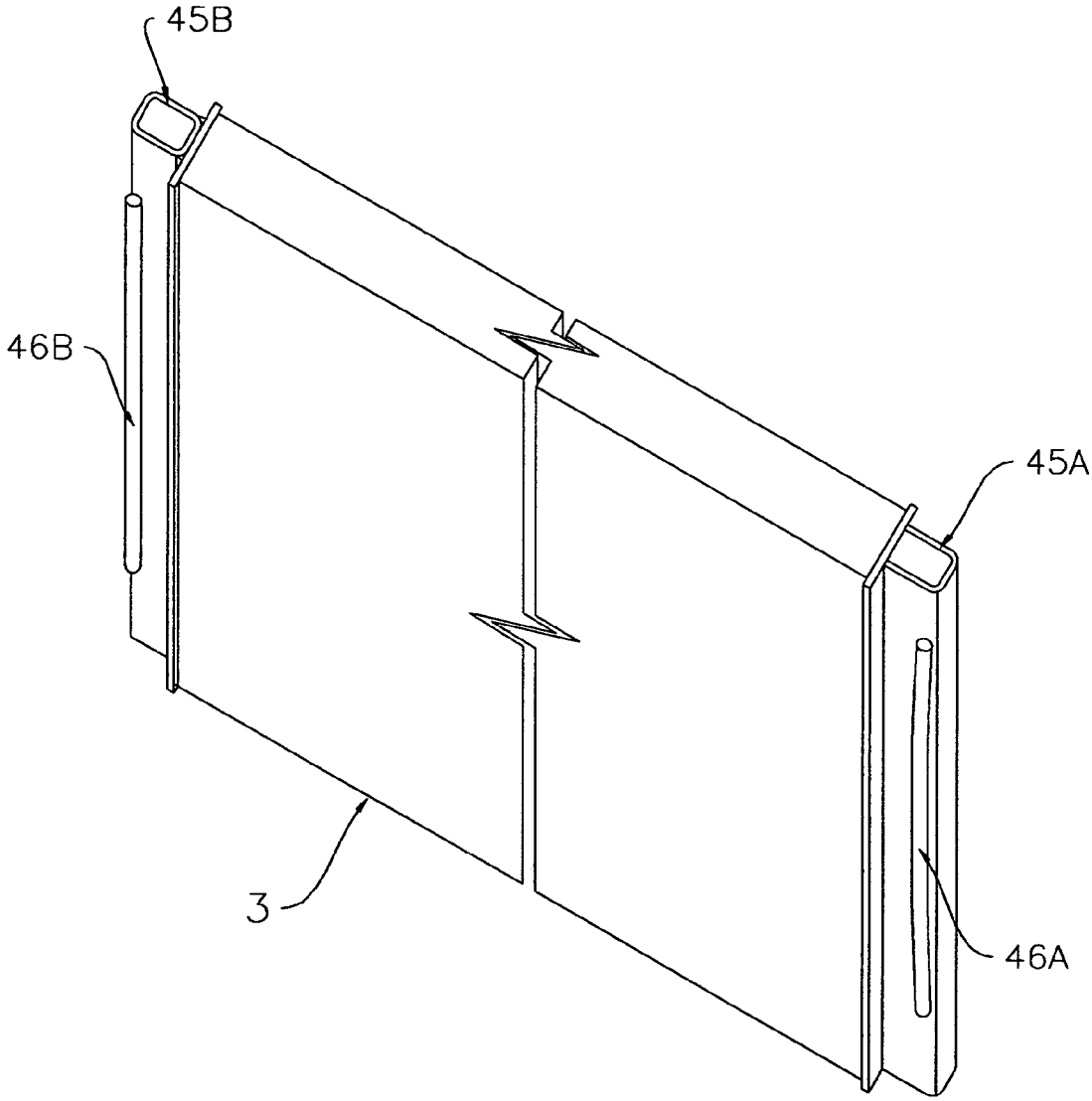
FIG. 18 is a three dimensional view of shoring panel showing the edge guides.

The shoring panel 3 as shown in FIG. 18, has laterally on either end, a guide edge 45A, 45B of U-shape or a rectangular tube, each of them provided on the back side relative to interior of excavation, with respective locking bars 46A and 46B of round or rectangular section. In one variation, the locking bar 46B is straight and flush to the narrow side of guide edge 45B. In another variation, the locking bar 46A is slightly bent so that either end is flush to narrow side of guide edge 45A while the center is inwardly offset up to 0.5" to 1", but not limited. Guide edge 45A, 45B may be total or partial relative to height of shoring panel 3. By preference, locking bars 46A, 46B are partial relative to guide edge 45A, 45B but could be total as well.

I claim:

1. A shoring system comprising:

a) linear rails, each said linear rail having opposing sides, each said opposing side having an outer guide running along entire length of said linear rail and an inner guide running partially from the bottom up, said outer guide and said inner guide being adapted to interlock shoring panels sliding vertically within, each said linear rail further comprising lengthwise an external edge guide;

b) corner rails, each said corner rail having oblique opposing sides, each said oblique opposing side having an outer guide running alone entire length of said corner rail and an inner guide running partially from the bottom up, said outer guide and said inner guide being adapted to interlock shoring panels sliding vertically within;

c) strutting assemblies, each said strutting assembly comprising at least one horizontal spreader and two vertical members, each said vertical member being adapted to cooperatively engage said edge guide of said linear rail and slide relatively;

d) shoring panels, each said shoring panel having laterally on either end an edge guide to interlock but slide vertically within said outer guide and said inner guide of said linear rail.

2. The shoring system of claim 1 wherein said linear rail has a lower section and an upper section, said lower section being defined by the length of said inner guide covering 30% to 75% of total length of said linear rail and said upper section being defined as complementary to said lower section, such that:

said upper section comprising a back flange and a front flange holding perpendicularly in between two parallel lateral flanges spaced apart to shape altogether a particular box beam having said back flange and said front flange projecting oppositely outward from lateral flanges;

said lower section comprising said back flange, said front flange and said lateral flanges continuing from said upper section, said lower section further comprising an intermediary flange and at least two strips, the width of said lateral flanges being slightly narrower than in said upper section so that one side of said intermediary flange fastens onto said lateral flanges while the other side, fastens via two said strips, onto said front flange, said intermediary flange projecting oppositely outward of lateral flanges shaping with said back flange a channel structure on either side of said linear rail, said strips aligning in between or in continuation of said lateral flanges shaping together with said front flange a frontal edge guide positioned lengthwise externally along said linear rail;

each said lateral flange having a separating member means projecting outward to shape in combination with said back flange and said intermediary flange respectively said outer guide and said inner guide;

said back flange having a locking bar welded onto each lip, interior to said outer guide, to interlock said shoring panels sliding within said outer guide, said locking bar running along entire length of said outer guide or partially;

said separating member optionally having, interior to said inner guide, a locking bar to interlock shoring panels sliding within said inner guide, said locking bar running along entire length of said inner guide or partially.

3. A linear rail as set forth in the claim 2 wherein the cross section of said separating member having a U-shape or a rectangular shape is being fabricated by mean of cutting lengthwise a rectangular tube, bending a flat bar or joining together flat bars.

4. The shoring system as set forth in claim 1, wherein said corner rail comprises:

a back flange and two structural channels held oppositely with their respective flanges looking outward, said back flange and each respective web of said structural channel being joined together to shape three faces of a hollow elongated polyhedron whose cross section is an isosceles triangle wherein the base is represented by said back flange, the legs by respective webs of said structural channels and the vertex angle taking any values between 15 and 90 degrees;

each said structural channel having a separating member and a locking bar, said separating member means projecting outward to shape said outer guide and said inner guide with respectively rear and front flanges of said structural channel, said locking bar being weld onto the lip of rear flange of said structural channel, interior to said outer guide, to interlock said shoring panels sliding within, said locking bar running along entire length of said outer guide or partially;

each separating member optionally having, interior to said inner guide, a said locking bar to interlock said shoring panels sliding within, said locking bar running along entire length of said inner guide or partially.

5. A corner rail as set forth in the claim 4 wherein the cross section of said separating member having a U-shape or a rectangular shape is being fabricated by mean of cutting lengthwise a rectangular tube, bending a flat bar or joining together flat bars.

6. A corner rail as set forth in claim 4 further including a reinforcing flange welded between flanges of respective said structural channels farthest from said back flange.

7. A corner rail as set forth in claim 4 further including an edge guide means for sliding a said strutting assembly, said edge guide being adapted onto flanges of said structural channels farthest from said back flange.

8. A corner rail as set forth in claim 6, wherein at said upper section, the flange of each said structural channel farthest from said back flange is cut close to its web to facilitate the insertion of panels within said inner guide.

9. A corner rail as set forth in claim 4, wherein:

at said upper section said structural channels are replaced by structural angles, said structural angle being oriented in alignment of said structural channels present in lower section of said corner rail, said upper section further comprising a front flange, said front flange joining on either end respective leg of each said structural angle, said upper section further including said separating members and said locking bars.

10. A shoring system as set forth in claim 1, wherein the strutting assembly comprising said horizontal spreader and vertical members such that:

each said vertical member consisting of two identical lateral plates held parallel at upper and lower ends respectively by an upper plate and a lower plate, a supporting plate welded laterally on one end of said lateral plates, and an inner plate welded in between said lateral plates; said lateral plates projecting outward past said inner plate to shape a guide channel to cooperatively slide over said edge guide of said linear rail, each said lateral plate having further a strip or the lip bent inward, to interlock said edge guide of said linear rail, said lateral plates being provided on upper and lower ends with holes to mount at least two axles for installing rollers;

each said vertical member having further a segmental tube weld onto opposite face relative to guide channel, said segmental tube being provided with flanges to connect via bolts onto said horizontal spreader;

said horizontal spreader being a structural beam provided on either side with flanges to connect via bolts onto vertical members.

11. A strutting assembly as set forth in claim 10, wherein said upper plate and said lower plate are provided with holes to allow the connection of two or more said strutting assemblies via vertical extension members, said vertical extension members having at upper and lower ends contact flanges with holes for bolting.

12. A shoring panel as set forth in claim 1, wherein each said edge guide consists of a rectangular tube and a locking bar of round or rectangular section.

13. A shoring panel as set forth in claim 12, wherein said locking bar welded along said rectangular tube means, for forming said edge guide, is slightly curved and has either extremity pointing laterally outward.

14. A shoring panel as set forth in claim 13 wherein said locking bar is 10% to 75% shorter than said rectangular tube of said edge guide.

* * * * *